US008789332B1

(12) United States Patent
Halliley et al.

(10) Patent No.: US 8,789,332 B1
(45) Date of Patent: Jul. 29, 2014

(54) PATTERN RANDOMIZATION OF A LAMINATED ROOFING SHINGLE

(75) Inventors: Alistair G. Halliley, Prior Lake, MN (US); Robert L. Jenkins, Honey Brook, PA (US); Joseph Quaranta, Yardley, PA (US)

(73) Assignee: CertainTeed Corporation, Valley Forge, PA (US)

( * ) Notice: Subject to any disclaimer, the term of this patent is extended or adjusted under 35 U.S.C. 154(b) by 524 days.

(21) Appl. No.: 12/965,086

(22) Filed: Dec. 10, 2010

Related U.S. Application Data

(60) Provisional application No. 61/285,596, filed on Dec. 11, 2009.

(51) Int. Cl.
*E04D 1/12* (2006.01)
*E04D 1/00* (2006.01)
*B65D 85/46* (2006.01)

(52) U.S. Cl.
USPC ..... 52/554; 52/518; 206/323; D25/139

(58) Field of Classification Search
USPC ..... 52/311.1, 314, 554, 555, 557, 518, 553; 428/141, 143, 144, 145; 206/323; D25/139
See application file for complete search history.

(56) References Cited

U.S. PATENT DOCUMENTS 1,894,614 A * 1/1933 Wettlaufer ..... 52/559
1,927,436 A * 9/1933 Fischer ..... 52/529
1,974,047 A * 9/1934 Harshberger ..... 52/555
2,235,212 A * 3/1941 Herscovitz ..... 52/518
2,863,405 A * 12/1958 Leibrook et al. ..... 52/420
3,624,975 A * 12/1971 Morgan et al. ..... 52/105
3,921,358 A * 11/1975 Bettoli ..... 52/314
4,010,592 A * 3/1977 Nixon ..... 52/748.1
4,266,388 A * 5/1981 Flood ..... 52/748.1
4,274,243 A * 6/1981 Corbin et al. ..... 52/748.1
4,499,702 A * 2/1985 Turner ..... 52/555
4,717,614 A * 1/1988 Bondoc et al. ..... 428/143
4,775,440 A * 10/1988 Jennus et al. ..... 156/260
4,869,942 A * 9/1989 Jennus et al. ..... 428/77
D309,027 S * 7/1990 Noone et al. ..... D25/139
5,052,162 A * 10/1991 Bush et al. ..... 52/518
5,102,487 A * 4/1992 Lamb ..... 156/260
D336,347 S * 6/1993 Hannah et al. ..... D25/139
D340,294 S * 10/1993 Hannah et al. ..... D25/139
5,375,387 A * 12/1994 Davenport ..... 52/557
5,666,776 A * 9/1997 Weaver et al. ..... 52/557
5,822,943 A * 10/1998 Frankoski et al. ..... 52/518
5,853,858 A * 12/1998 Bondoc ..... 428/195.1
5,953,877 A * 9/1999 Kalkanoglu et al. ..... 52/554
5,961,780 A * 10/1999 Kalkanoglu et al. ..... 156/517
6,010,589 A * 1/2000 Stahl et al. ..... 156/260
6,014,847 A * 1/2000 Phillips ..... 52/311.1
6,038,827 A * 3/2000 Sieling ..... 52/557
6,044,608 A 4/2000 Stahl et al.
6,058,670 A * 5/2000 Sieling et al. ..... 52/554
6,092,345 A * 7/2000 Kalkanoglu et al. ..... 52/554
6,105,329 A * 8/2000 Bondoc et al. ..... 52/557
6,190,754 B1 * 2/2001 Bondoc et al. ..... 428/143
6,289,648 B1 * 9/2001 Freshwater et al. ..... 52/557

(Continued)

*Primary Examiner* — Basil Katcheves
*Assistant Examiner* — Rodney Mintz
(74) *Attorney, Agent, or Firm* — Paul & Paul

(57) ABSTRACT

A method of producing laminated roofing shingles is provided, wherein the shingles are of a dragon's tooth type, and shingles made in accordance with the method, and packages of such shingles.

12 Claims, 5 Drawing Sheets

(56) References Cited

U.S. PATENT DOCUMENTS

| | | | | |
|---|---|---|---|---|
| 6,355,132 | B1 | 3/2002 | Becker et al. | |
| 6,361,851 | B1 * | 3/2002 | Sieling et al. | 428/144 |
| 6,367,627 | B2 * | 4/2002 | Freiborg et al. | 206/323 |
| 6,401,425 | B1 * | 6/2002 | Frame | 52/748.1 |
| 6,419,780 | B1 * | 7/2002 | Queisser | 156/259 |
| 6,487,828 | B1 * | 12/2002 | Phillips | 52/554 |
| 6,510,664 | B2 * | 1/2003 | Kupczyk | 52/528 |
| 6,521,076 | B1 * | 2/2003 | Elliott | 156/259 |
| 6,679,020 | B2 * | 1/2004 | Becker et al. | 52/518 |
| 6,679,308 | B2 * | 1/2004 | Becker et al. | 156/512 |
| 6,691,489 | B2 * | 2/2004 | Frame | 52/748.1 |
| 6,804,919 | B2 * | 10/2004 | Railkar | 52/105 |
| 6,823,637 | B2 * | 11/2004 | Elliott et al. | 52/557 |
| 6,920,730 | B2 * | 7/2005 | Becker et al. | 52/518 |
| 6,933,037 | B2 * | 8/2005 | McCumber et al. | 428/143 |
| 6,968,662 | B2 * | 11/2005 | Rodrigues | 52/518 |
| 6,986,299 | B2 * | 1/2006 | White et al. | 83/76.1 |
| 6,990,779 | B2 * | 1/2006 | Kiik et al. | 52/554 |
| 7,082,724 | B2 * | 8/2006 | Railkar et al. | 52/105 |
| 7,537,820 | B2 * | 5/2009 | Kalkanoglu et al. | 428/143 |
| 7,607,275 | B2 | 10/2009 | Elliott et al. | |
| 7,805,905 | B2 * | 10/2010 | Rodrigues et al. | 52/557 |
| 7,827,753 | B2 * | 11/2010 | Nagarajan et al. | 52/560 |
| 7,836,654 | B2 * | 11/2010 | Belt et al. | 52/557 |
| 7,861,631 | B2 * | 1/2011 | Freshwater et al. | 83/332 |
| 7,877,949 | B1 * | 2/2011 | Elliott | 52/555 |
| 8,156,704 | B2 * | 4/2012 | Belt et al. | 52/557 |
| 8,181,413 | B2 * | 5/2012 | Belt et al. | 52/557 |
| 8,240,100 | B2 * | 8/2012 | Kalkanoglu et al. | 52/518 |
| 8,240,102 | B2 * | 8/2012 | Belt et al. | 52/557 |
| 8,307,599 | B2 * | 11/2012 | Jenkins et al. | 52/533 |
| 8,309,169 | B2 * | 11/2012 | Teng et al. | 427/188 |
| 8,381,489 | B2 * | 2/2013 | Freshwater et al. | 52/748.1 |
| 8,383,228 | B2 * | 2/2013 | Kalkanoglu et al. | 428/143 |
| 8,397,460 | B2 * | 3/2013 | Rodrigues et al. | 52/557 |
| 8,424,681 | B1 * | 4/2013 | Schonhardt et al. | 206/323 |
| 8,438,812 | B2 * | 5/2013 | King et al. | 52/554 |
| 8,557,366 | B2 * | 10/2013 | Harrington et al. | 428/141 |
| 8,592,025 | B2 * | 11/2013 | Kalkanoglu et al. | 428/143 |
| 2002/0033225 | A1 * | 3/2002 | Becker et al. | 156/260 |
| 2003/0040241 | A1 * | 2/2003 | Kiik et al. | 442/242 |
| 2003/0097811 | A1 * | 5/2003 | Becker et al. | 52/518 |
| 2003/0163964 | A1 * | 9/2003 | Elliott | 52/314 |
| 2003/0172611 | A1 * | 9/2003 | Coco et al. | 52/554 |
| 2004/0055241 | A1 * | 3/2004 | Railkar | 52/555 |
| 2004/0079042 | A1 * | 4/2004 | Elliott | 52/557 |
| 2004/0084338 | A1 * | 5/2004 | Railkar et al. | 206/323 |
| 2004/0111996 | A1 * | 6/2004 | Heroneme | 52/518 |
| 2004/0123543 | A1 * | 7/2004 | Elliott et al. | 52/518 |
| 2004/0144060 | A1 * | 7/2004 | Becker et al. | 52/745.15 |
| 2004/0258883 | A1 * | 12/2004 | Weaver | 428/143 |
| 2005/0000335 | A1 * | 1/2005 | Freshwater et al. | 83/37 |
| 2005/0193673 | A1 * | 9/2005 | Rodrigues et al. | 52/518 |
| 2005/0235599 | A1 * | 10/2005 | Kalkanoglu et al. | 52/746.11 |
| 2006/0179767 | A1 * | 8/2006 | Miller et al. | 52/555 |
| 2007/0011978 | A1 * | 1/2007 | Kalkanoglu et al. | 52/518 |
| 2007/0017330 | A1 * | 1/2007 | Freshwater et al. | 83/13 |
| 2007/0068108 | A1 * | 3/2007 | Kiik et al. | 52/518 |
| 2009/0178523 | A1 * | 7/2009 | Freshwater et al. | 83/32 |
| 2010/0192496 | A1 * | 8/2010 | Koch et al. | 52/309.3 |
| 2010/0205887 | A1 * | 8/2010 | Riina | 52/518 |
| 2010/0266811 | A1 * | 10/2010 | Kalkanoglu et al. | 428/143 |
| 2011/0041421 | A1 * | 2/2011 | Jenkins | 52/105 |
| 2011/0185668 | A1 * | 8/2011 | Kiik et al. | 52/518 |
| 2013/0019554 | A1 * | 1/2013 | Rodrigues et al. | 52/557 |
| 2013/0020381 | A1 * | 1/2013 | Koch et al. | 229/87.01 |
| 2013/0025225 | A1 * | 1/2013 | Vermilion et al. | 52/518 |
| 2013/0025226 | A1 * | 1/2013 | Jenkins et al. | 52/557 |
| 2013/0219819 | A1 * | 8/2013 | Kalkanoglu et al. | 52/543 |
| 2013/0239506 | A1 * | 9/2013 | Ray et al. | 52/553 |
| 2013/0298490 | A1 * | 11/2013 | Jenkins et al. | 52/557 |

* cited by examiner

PATTERN RANDOMIZATION OF A LAMINATED ROOFING SHINGLE

CROSS-REFERENCE TO RELATED APPLICATIONS

This non-provisional application claims priority from U.S. provisional application Ser. No. 61/285,596 filed Dec. 11, 2009, the complete disclosure of which is herein incorporated by reference.

BACKGROUND OF THE INVENTION

In the prior art, it is known to produce laminated roofing shingles. Most particularly, it is known to produce laminated roofing shingles wherein the shingles are comprised of a fiber sheet or mat that is impregnated with a bituminous material, such as asphalt, and with granules applied on a surface of the shingles that are to be weather-exposed in the installed condition, and with generally smaller particles such as mica, sand or the like applied to the rear of the shingles, to prevent multiple shingles in a given stack or package from adhering to each other.

It is also known in the roofing art that laminated shingles may be made by cutting shingle material of the type described above, to have tabs, with spaces between the tabs, and wherein strips of additional shingle material are applied to the posterior surfaces of the shingle material having tabs thereon, to underlie the spaces between adjacent tabs. Generally such posterior-applied shingle material is of a shorter dimension than the anterior shingle layer, in that it need not extend from the lower ends of the tabs, up to the upper end of the headlap portion, although, such a full height posterior layer can be provided, if desired.

It is generally recognized that it is more economical to provide a posterior layer of shingle material that is slightly more than half the height of the anterior layer of shingle material, so that it extends from the lower ends of the tabs of the anterior layer, to just above the upper ends of the slots or cutouts, so that the slots between adjacent tabs are fully covered.

It has been recognized that highly desirable, aesthetic effects can be obtained by using an anterior layer of shingle material that has wide slots between adjacent tabs. Such an aesthetic effect is known as a "dragon's tooth" effect.

Examples of a dragon's tooth effect exist in U.S. Pat. Nos. 6,044,608; 6,355,132 and U.S. Pat. No. 7,607,275, the complete disclosures of which are herein incorporated by reference.

It has been found that, when dragon's tooth type laminated shingles are laid up on a roof, if the shingles were produced on a production line with a continuous and repeating pattern cut into the shingle material by means of a pattern of blades on the circumference of a cutting cylinder, thereafter, when the shingles thus manufactured are laid up in courses on a roof, there may appear a pattern to the thus laid-up shingles that may not be desirable, such as, the appearance of the dragon's teeth in a generally straight line, often appearing as a sloped line of teeth, when the roof with shingles thus applied is viewed from ground level.

THE PRESENT INVENTION

The present invention is directed to an apparatus and process for manufacturing laminated shingles of the type described above, wherein undesirable patterns of shingles are minimized, or at least reduced, when the shingles are laid up in courses on a roof, such that randomization of the shingles is achieved, avoiding undesirable patterns. Accordingly, the present invention is aimed at increasing the randomization of a laminated roofing shingle pattern cut design, so that when the cut design is incorporated into shingles and they are applied to a roof, such will minimize application patterning for multiple methods of application. The present invention is also directed to the shingles themselves and packages of such shingles.

SUMMARY OF THE INVENTION

The present invention provides a laminated roofing shingle cut pattern design that may or may not incorporate a mixing of production lanes of cut shingles, in the same bundle or package, such that, when shingles from a given package are installed on a roof, there will result a more random application and aesthetically pleasing appearance to the roof.

Accordingly, it is an object of this invention to provide a novel shingle cut pattern, for cutters in a shingle production line.

It is a further object of this invention to cut multiple shingles of a dragon's tooth type, on a single production line.

It is yet another object of this invention to provide novel shingles and a more random stacking of shingles that are cut from a single production line, in a given bundle or package, for application to a roof with an enhanced randomization, and less apparent patterning.

Other objects and advantages of the present invention will be readily apparent upon a reading of the following brief descriptions of the drawing figures, the detailed descriptions of the preferred embodiments and appended claims.

BRIEF DESCRIPTIONS OF THE DRAWING FIGURES

Figure 1:
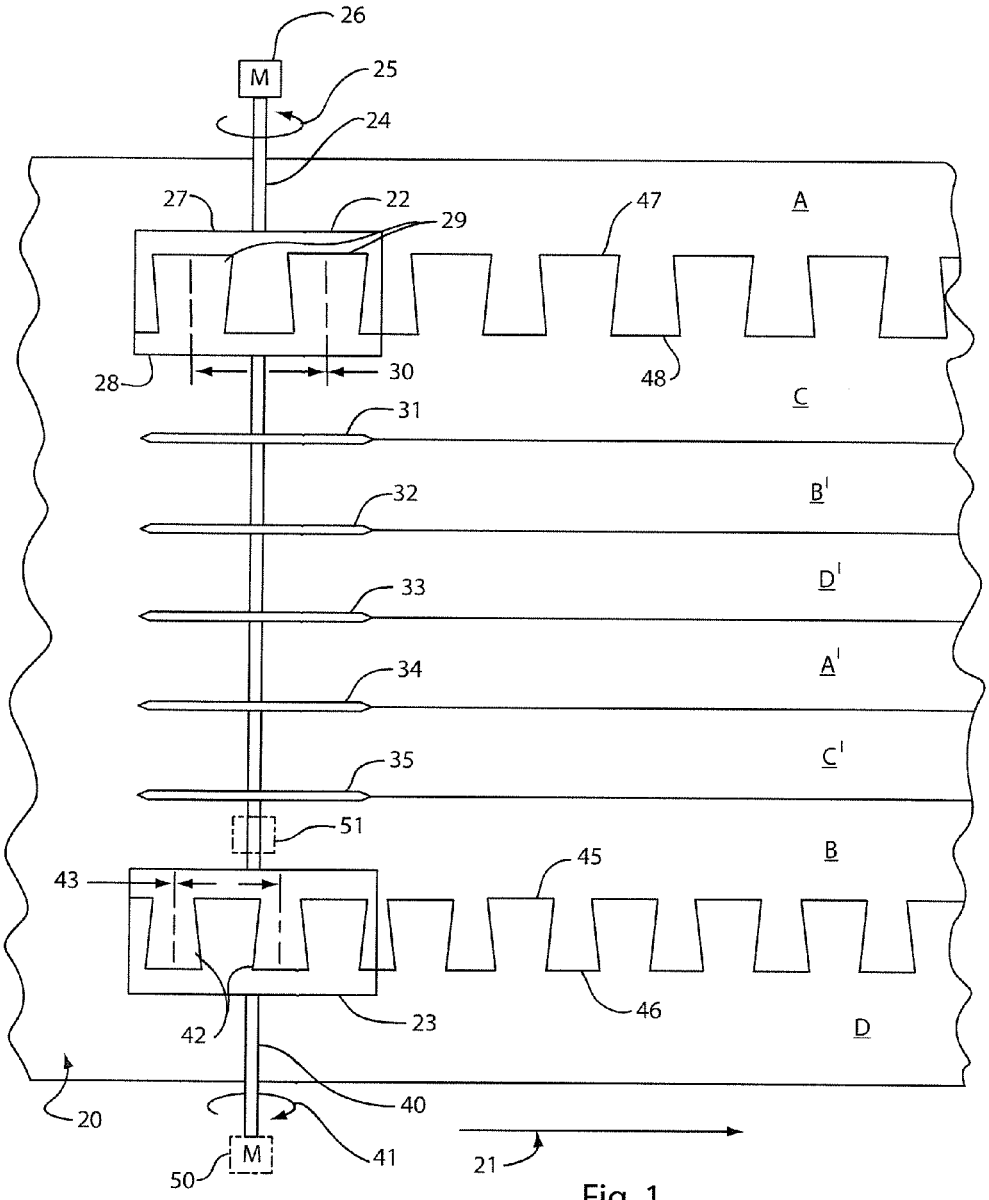
FIG. 1 is a fragmentary illustration of a shingle production line, in which multiple shingle layers are cut from the same production line.
Figure 6:
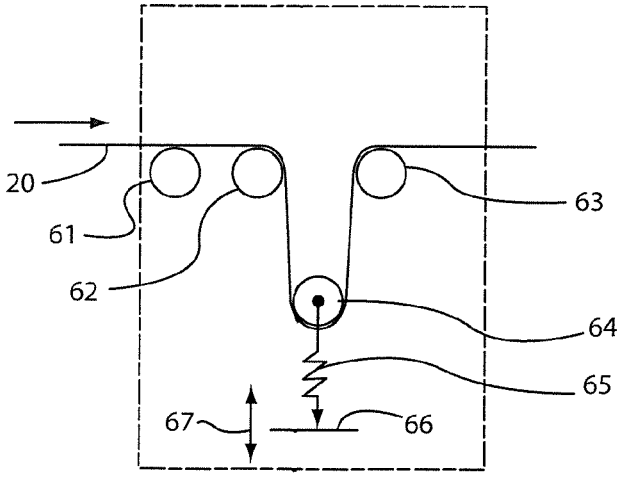

FIG. 6 is a fragmentary illustration wherein of a portion VI of the production line from each of FIGS. 2 through 5 is shown enlarged, and wherein a variable tension loop can be raised or lowered as the laminated shingles are being delivered through the production processes as shown in FIGS. 2 through 5, for producing even greater variation and randomization of shingles from the production line of FIG. 1, when they are stacked in a bundle or package.

FIGS. 7 through 10 are illustrations of the manner in which different laminated shingles made in accordance with the production line of FIGS. 1 through 6 can be oriented relative to each other in a given bundle or package.

Figure 11:
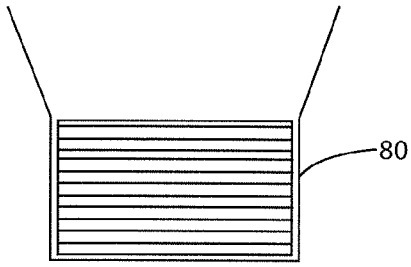

FIG. 11 is an illustration of a plurality of shingles made in accordance with this invention, stacked in a given package.

Figure 12:
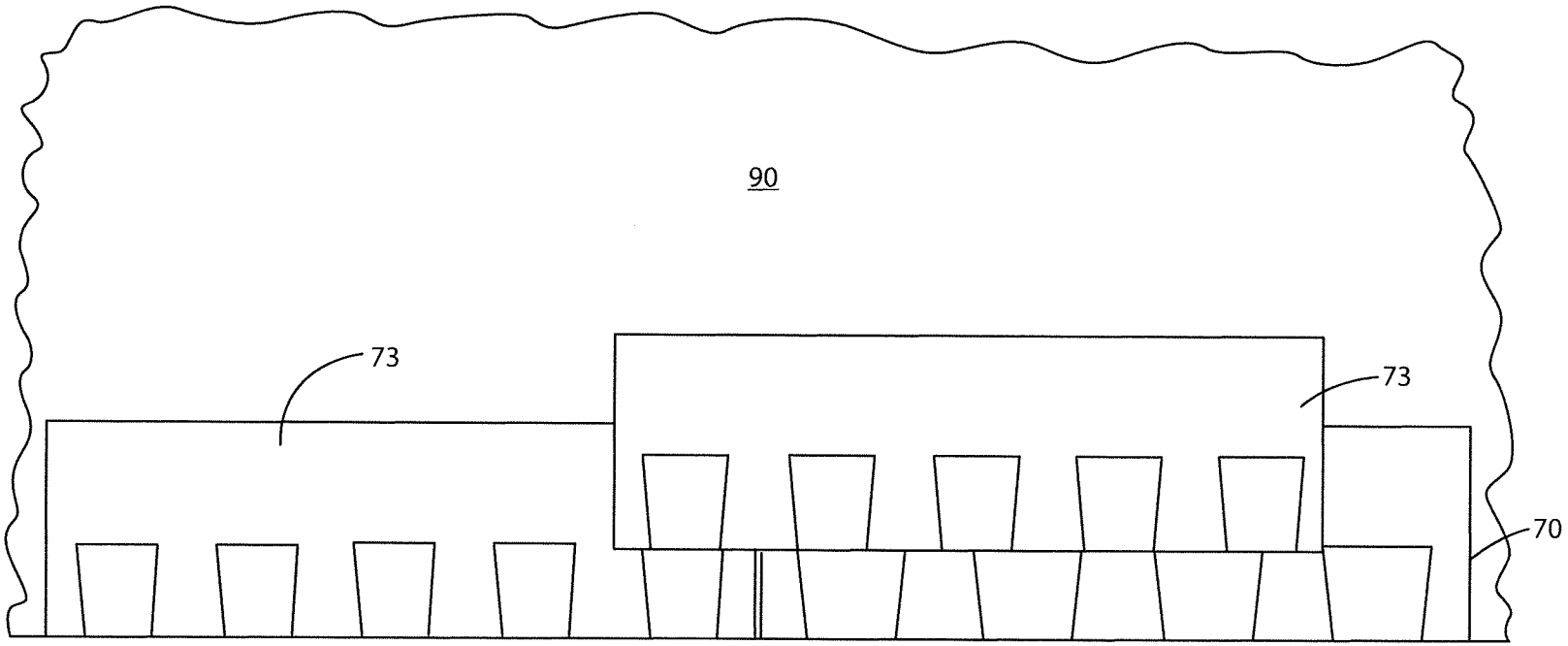

FIG. 12 is an array of shingles in accordance with this invention, laid up on a roof, in two partial courses.

DETAILED DESCRIPTIONS OF THE PREFERRED EMBODIMENTS

Referring now to the drawings in detail, reference is first made to FIG. 1, wherein a sheet of shingle material 20 is illustrated, as comprising a web or mat of suitable material such as fiberglass, impregnated with a bituminous material such as asphalt, and with granules applied to one surface, that is to be the weather-exposed surface when installed on a roof, and with smaller particles such as mica, sand or the like applied on the opposite surface that is to be the surface of the shingle that is unexposed when installed on a roof. The shingle material 20 is delivered along a path, in the direction of the arrow 21.

As the shingle material 20 is moved along the generally horizontal path 21, it passes above or beneath a plurality of pattern cutters 22, 23, each of the generally cylindrical type.

The cutters 22, 23 are suitably shaft-mounted as shown in FIG. 1.

The generally cylindrical pattern cutter 22 is mounted on a suitable rotating shaft 24, rotatable in a given direction as indicated by the arrow 25, and driven preferably by means of a motor 26.

The cutter 22 will preferably have an even number of cutting teeth 29 on each end 27, 28 thereof, with adjacent cutting teeth on each end 27 or 28 being spaced apart by a given center line distance 30, measured between the center lines of the cutting teeth on each end 27, or 28 of the cutter 22.

The shaft 24 may also carry and likewise drive, disk-like cutters 31, 32, 33, 34 and 35, for cutting a plurality of strips B', D', A' and C', between dragon's tooth shingle layers C and B, as shown.

Thus, the cutter 22 when rotated, will cut shingle layers with dragon's tooth type slots between what will become anterior shingle layers A and C.

Similarly, the cutter 23, carried on the shaft 40 for rotation therewith in the direction of the arrow 41, will have cutting teeth 42 on its outer cylindrical surface, for cutting dragon's tooth type cuts in the shingle layer disposed thereabove or therebeneath, to generate dragon's tooth cuts in what will become anterior shingle layers B and D of a laminated shingle, as shown at the lower end of FIG. 1. The center line spacing 43 between adjacent cutting teeth for the cutter 23 will be a different, smaller, center line spacing 43 than the center line spacing 30 described above.

The cylindrical cutter 23 will preferably have its cutting edges 42 arranged thereon, to cut an uneven number of dragon's tooth cuts by means of the cylindrical cutter 23, preferably by at least 5% more cuts than will be cut by the cutter 22.

Thus, the cutter 23 will cut in the shingle material 20, a greater number of teeth 45, 46 per lineal yard, than will the cutter 22 cut a given number of lineal teeth 47, 48 per lineal yard.

Both cutters 22 and 23 cut against anvil rollers (not shown) with the shingle material 20 between the cutters 22, 23 and the anvil rollers.

The shaft 40 can be connected to be driven along with the shaft 24 by means of the motor 26, or, alternatively, can be driven by its own motor 50, shown in phantom in FIG. 1, and can be connected to an end of the shaft 24 by means of a slip-fit connection, as shown in phantom at 51, if desired.

Thus, the shingle cutting mechanism illustrated in FIG. 1 will produce anterior, dragon's tooth type shingle material layers A and C at one side of the illustration of FIG. 1, and similar dragon's tooth type anterior shingle material layers, but having a greater number of teeth per lineal yard, B and D at the lower end of FIG. 1.

In between the dragon's tooth type layers B and C, there are provided partial height posterior shingle material layers B', D', A' and C' of shingle material, referred to as "shim" layers.

It will be understood that in some production lines, the dragon's tooth type layers of shingle material can be produced at other locations transversely of the production line, with (shim) layers of shorter height shingle material that are designed to be posterior layers of shingle material, disposed transversely outwardly, of the dragon's tooth type anterior layers of shingle material, or otherwise laterally disposed relative to the dragon's tooth type anterior layer of shingle material.

It is of significance that, in accordance with the present invention, the two pairs of lanes that make up the dragon's teeth layers; namely lanes A/C, and lanes B/D differ from each other. The differences can be having different numbers of teeth on the cutter 22 or 23 that cuts the dragon's tooth layers, or an even number of teeth on one of the cutters and an odd number of teeth on the other cutter. For example, one could have a much larger roller comprising one of the cutters 22 or 23, or the rollers for the cutters 22, 23 could both have even numbers or odd numbers, in a situation wherein both rollers have a much larger diameter. In such a case, both rollers 22, 23 could have an even number of cutting teeth, such as one with the ability to cut 8 teeth and the other with the ability to cut 10 teeth, or alternatively one with the ability to cut 9 teeth and the other with the ability to cut 11 teeth, all of which arrangements would produce a comparable effect, such that the cutters would differ from each other so that they produce two differently cut pairs of lanes of dragon's tooth shingle material.

Similarly, the dragon's tooth type layers of shingle material B and D can be produced from a different production line than that which produces the dragon's tooth type layers A and C from the cutter 22 of FIG. 1.

Figures 2, 3, 4, 5:
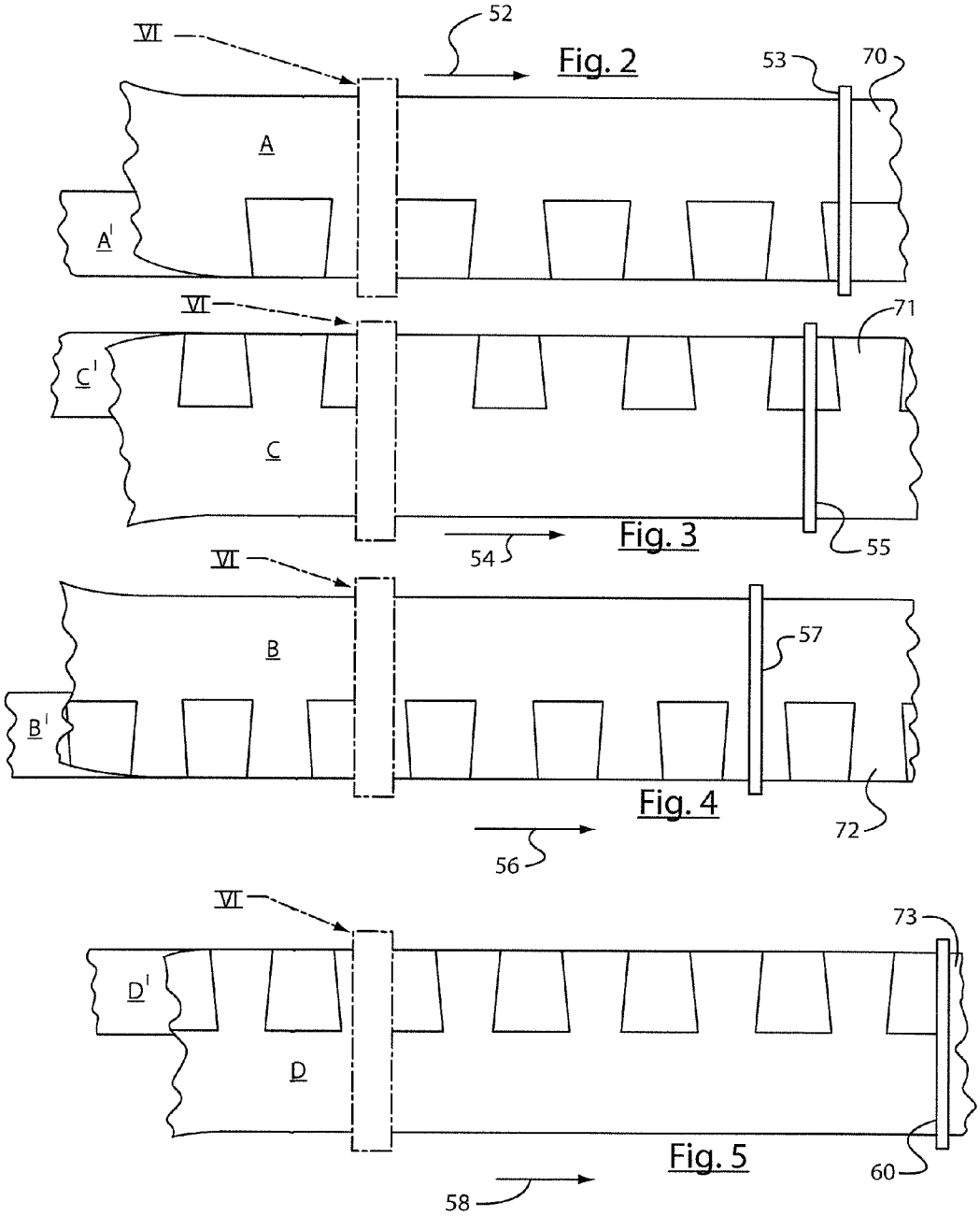
FIG. 2 is a fragmentary illustration of the bringing together of a full height anterior shingle layer of a dragon's tooth type, defined as one having wide spaces between teeth as shown, with a backing or posterior layer applied thereto, for delivery to a shingle length cutter during the shingle making process.
FIG. 3 is an illustration similar to that of FIG. 2, wherein a different anterior shingle layer has a different backing layer laminated thereto.
FIG. 4 is an illustration similar to that of FIG. 3, but with even different anterior and posterior shingle layers being laminated together.
FIG. 5 is an illustration similar to FIGS. 3 and 4, where different anterior and posterior shingle layers from the production line are likewise laminated together.

With reference to FIG. 2, it will be seen that the dragon's tooth layer A has laminated thereto, the backing or shim layer A', by bringing the backing layer A' against the posterior surface of the anterior layer A, and is adhered thereto by lamination means not shown, for delivery along a path indicated by the arrow 52, to a location where a cutter 53 will cut the laminated shingle material of FIG. 2 to a desired length, such as, for example, 38¾ inches, from a cutter roller of approximately 42¼ inch diameter, to produce a pattern that repeats after approximately every 7 or 8 shingles. The cutters 53, 55, 57 and 60, while being illustrated as blades in FIGS. 2-5, will preferably be cutting rollers of greater diameter than the length of shingle to be cut. For example, for a shingle of 38¾ inch length, the cutting rollers 53, 55, 57, 60 could be 42¼ inches in diameter.

Similarly, the backing or shim layer C' from FIG. 1 is laminated to the dragon's tooth type anterior shingle layer C as shown in FIG. 3, for likewise delivery in the direction of the arrow 54, to a cutter 55, for cutting the laminated shingle of a given desired length from the laminated shingle material of FIG. 3.

In FIG. 4, a backing or shim layer B' is brought against the posterior surface of the anterior layer B of dragon's tooth type shingle material, laminated thereagainst by means of a suitable adhesive, for delivery in the direction of the arrow 56 to the cutter 57.

In FIG. 5, a backing or shim layer D' is brought against the posterior surface of a dragon's tooth type layer D of shingle material, for delivery in the direction of the arrow 58 to a cutter 60 for likewise cutting the thus laminated shingle material of FIG. 5 to a desired length.

The backing layers A', B', C' and D', as shown in FIGS. 2-5 have no spaced-apart tabs, but the anterior layers, A, B, C and D have a spacing between the tabs that may vary and is preferably greater than two inches and more preferably is greater than 2½ inches, such as from about 3 to 7 inches. The tabs may be of equal and/or unequal widths and each width typically is in the same range as out of the spaces therebetween. The tabs may have various shapes.

It will be noted that the cutters 53, 55, 57 and 60 may be disposed at different linear locations, not aligned, as viewed in the collective illustrations of FIGS. 2-5, for enhancing the eventual randomness of shingles made in accordance with the illustrations of FIGS. 2-5, when the shingles are packaged in a common bundle or package.

It will thus be seen, with reference to FIGS. 2-5, that laminated dragon's tooth shingles 70, 71, 72 and 73 are produced in accordance with the respective illustrations of FIGS. 2-5.

With respect to FIG. 6, it will be seen that the sheet 20 of shingle material can pass over a roller 61, then around a roller 62, beneath a roller 64, and back upwardly and around roller 63, to continue moving horizontally.

The roller 64 can be raised or lowered by means of a variable tension loop provided by roller 64, with the tension being supplied by a suitable spring mechanism 65 or the like mounted at 66, which may be adjusted upwardly or downwardly as indicated by the double-headed arrow 67, such that the roller 64 can absorb or release different lineal amounts of shingle material 20 toward any of the cutters 53, 55, 57 or 60 as may be desired, for each of the laminated layers of shingle material shown in FIGS. 2-5.

Figure 7:
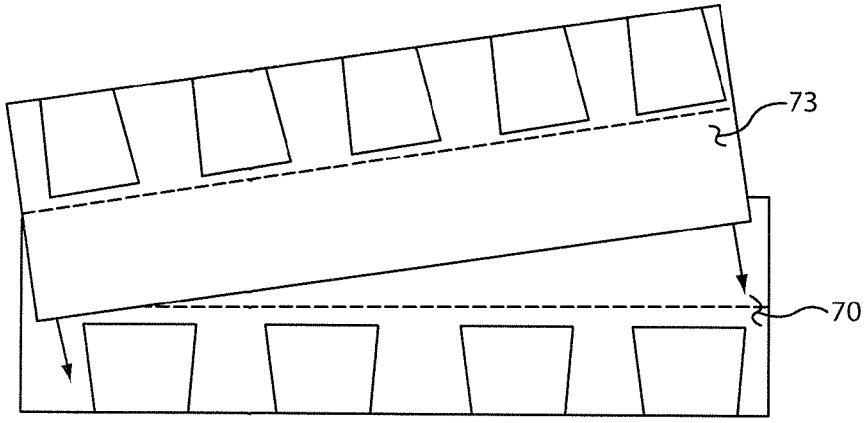

With reference now to FIG. 7, it will be seen that, in making a bundle or package of shingles, a laminated shingle 70 may have a laminated shingle 73, with a larger number of smaller dragon's tooth slots between adjacent tabs of the anterior shingle layer disposed thereover, followed by another laminated shingle 70 (not shown) disposed above the shingle 73, followed by another laminated shingle 73 (not shown) disposed over the latter shingle 70, etc., such that, as a bundle or package of shingles is built up, alternating shingles 70, 73 have their dragon's teeth facing in opposite directions, as illustrated in FIG. 7.

Figure 8:
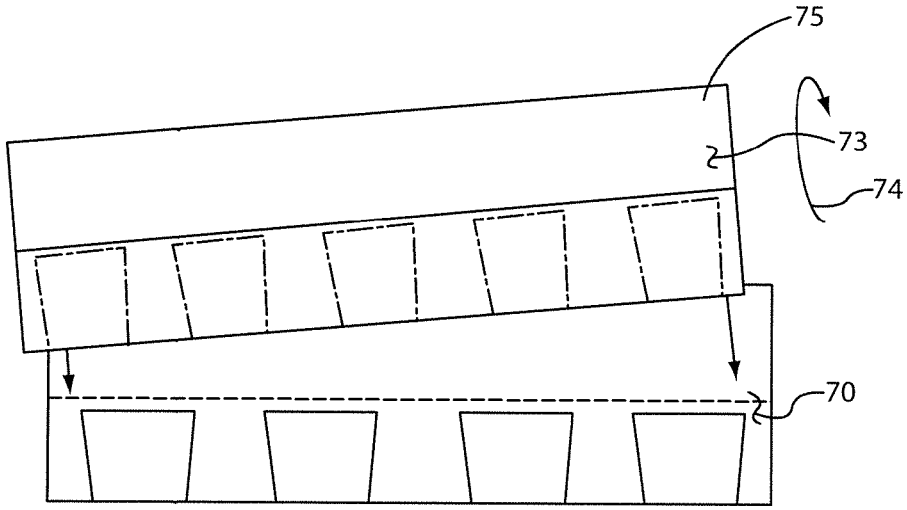

An alternative arrangement for bundling or packaging adjacent shingles is illustrated in FIG. 8, wherein the laminated shingle 73 of FIG. 7 is shown rotated in the direction of arrow 74, such that its dragon's teeth are facing in the same direction as the dragon's teeth for the laminated shingle 70, and disposed thereagainst, with the back surface 75 for the laminated shingle 73 being now turned to be upwardly-facing. Subsequent laminated shingles 70, 73 may continue to be stacked in this manner, alternating as 70, 73, 70, 73 etc.

Figure 9:
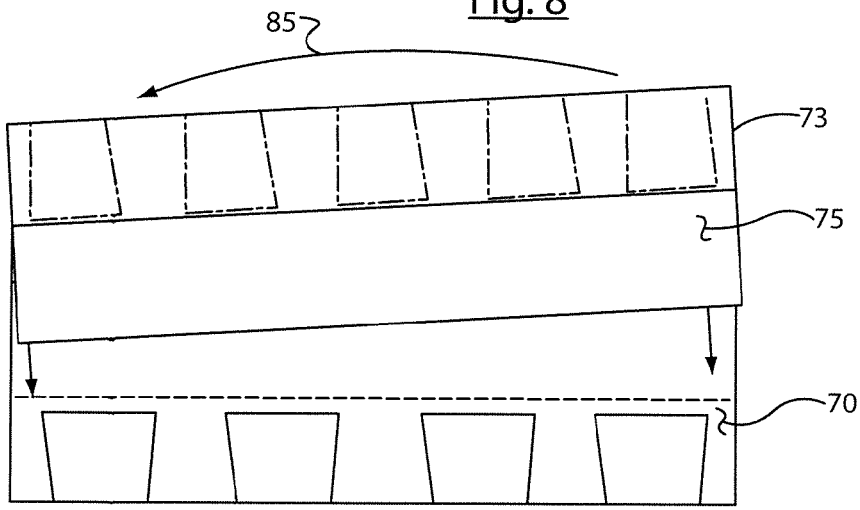

In FIG. 9, the stacking of bundling arrangement is like that of FIG. 8, except that the laminated shingle 73 of FIG. 8 is rotated 180° as shown by the arrow 85 so that its dragon teeth are oriented outwardly, as shown. It is preferred to have the dragon teeth facing in opposite directions in order to avoid building up excess thickness on one side of a bundle.

Figure 10:
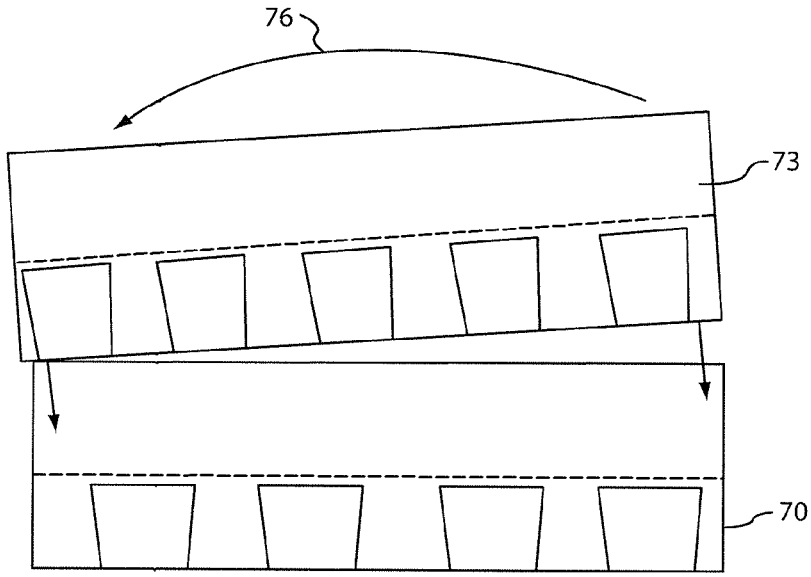

In FIG. 10, another stacking or bundling arrangement is illustrated, in which the laminated shingle 73 is stacked over the laminated shingle 70, with its dragon's teeth facing in the same direction as are the dragon's teeth of the laminated shingle 70. In this arrangement, the laminated shingle 73 has been rotated endwise as shown by the arrow 76 from the orientation of the laminated shingle 73 illustrated in FIG. 7, so that the right-most end of the laminated shingle 73 as illustrated in FIG. 7 is now at the left-most end of the arrangement of FIG. 10, and the left-most end of the laminated shingle 73 as shown in FIG. 7 is now at the right-most end in the arrangement of FIG. 10.

While the various arrangements of FIGS. 7-10 are presented with respect to the laminated shingles 70 and 73, it will be understood that similar arrangements for stacking/bundling of the laminated shingles 71 and 72 may likewise be effected. Adjacent laminated shingles can be face to back as in FIG. 7, face to face as in FIGS. 8 and 9, or back to back (not shown).

Other than the various combinations of backing or shim layers relative to dragon's tooth type layers illustrated in FIGS. 2-5, it will be understood that various other arrangements may be made. For example, the backing or shim layer for the dragon's tooth layer A could be any of backing or shim layers A', B', C' or D'. Likewise, any of the backing or shim layers for dragon's tooth type layer C could be any of backing or shim layers A', B', C' or D'. Likewise any of the backing or shim layers for dragon's tooth layers B and D could be any of backing or shim layers A', B', C' or D'. Additionally, when placing layers in a stack, any of the shingles can be turned over with their backing layer facing upwardly when going into the stack in a bundle.

It will also be apparent that other arrangements for varying the manner of stacking shingles can be effected, to further enhance the randomness of shingles in a stack, such that when a shingle installer takes shingles from a stack for application to a roof, the different orientations of the shingles in a stack, and the different orientations of shingles in multiple stacks or packages of shingles, will facilitate further avoidance of undesirable patterning as the shingles are installed on a roof.

In FIG. 11, a typical arrangement of a plurality of laminated shingles in accordance with this invention is illustrated, depending upon the desired stacking, in a suitable wrapper or package 80, for shipment of the package of shingles to a site of application.

With reference to FIG. 12, a roof 90 is fragmentally illustrated, in which, in a lower course there are illustrated a pair of adjacent shingles 70 and 73, with another shingle 73 laid up in a somewhat staggered arrangement, and principally overlying a substantial part of the shingle 70, with the tab portion of the shingle 73 in the overlying course covering the butt or headlap portion of the shingle 70 in an underlying course. It will be understood that the roof 90 will be covered by different shingles, such as 70 and 73, in a plurality of succeeding courses.

While the illustrations of this invention are addressed to a pair of cutting cylinders as illustrated in FIG. 1, it will be understood that in some shingle production arrangements an even larger number of cutting cylinders may be used to produce shingles that can come together or be combined separately in a bundle, or which can be produced and combined separately as an offline operation, at the same or at a later time.

In accordance with one aspect of this invention it will be understood that cylindrical cutters, when used with this invention will provide from one cutter, an even number of dragon's teeth, and with the other cutter, an uneven number of dragon's teeth when the cutting roller are of the same or similar diameter, for facilitating further randomization of dragon's teeth on the laminated shingles when they are installed on a roof.

As described above, for the cylindrical cutters, a given pattern cut may have a first center line spacing from tooth-to-tooth, and a different cutter may have a different centerline spacing, preferably with a difference in spacings of cutting teeth on cutters of 5% or greater in number.

The center line "tooth" spacings for the portions of the cutting rollers that cut the dragon's teeth could be an average spacing for the dragon's teeth cutters on any particular cutting roller. For example, usually not all of the dragon's teeth are exactly the same, with some being slightly larger and some being slightly smaller, such that the absolute center line distances from tooth to tooth would vary, whereby a given cutting roller would have an average center line spacing. A second roller for cutting other dragon's teeth could have a different average center line spacing, yet, from a given tooth to an adjacent tooth there could be some variation, but the second cutting roller would have a variation on a different scale. Thus, for two different cutting rollers, one could have a first average spacing between the means for cutting adjacent teeth, and the other roller could have a second, but different average spacing between adjacent cutting means thereon. Also, the cutting rollers could have the same number of teeth, but be of different diameters to provide different average-tooth centerline spacing.

Also, in accordance with this invention, a given pattern cut may be shorter or longer, or of different lengths and different lengths of repetition, with such different lengths being illustrated by the placement of cutters 53, 55, 57 and 60 as illustrated in FIGS. 2-5, for example.

By cutting dragon's teeth in accordance with this invention, as well as by stacking shingles made in accordance with this invention in varying manners, multiple differences between shingles in a stack may be produced, so as to vary large and small differences for facilitating increased randomization of dragon's tooth presentations of the shingles when the shingles are installed on a roof.

It will be apparent from the above that in accordance with this invention, a pattern cut is presented as an uneven, uniform or non-uniform pattern that results in an interlaced design having distinct patterns after separation from the original sheet 20 of shingle material. The pattern cut locations along a path of travel 21, as illustrated in FIG. 1 can be offset or staggered in relation to each other, and production lanes having distinct patterns can be combined as needed by crossovers, and/or twisting, to combine lanes or mixing during packaging of two or more lanes, as are illustrated for example in FIGS. 7-9 to increase the randomization of the cut pattern of shingles in the package, in order to improve the flexibility for multiple application methods when installing the shingles on a roof. Additionally, such may increase the randomization of the cut patterns of the shingles when applied to a roof, in order to enhance the visual aesthetics, increasing further randomization by combining one or more cut designs in the same package.

Additionally, the shingles can be stacked in a given package in accordance with any of the arrangements of FIGS. 7-10, as well as other arrangements, in order to improve weight distribution in the package and/or to improve the balance of pattern cut layers within the package and that such mixing of production lanes as described above, to produce different packaging arrangements within a given package may further enhance the randomness and aesthetic appearance of shingles when applied to a roof.

It will be apparent from the foregoing that various modifications and alternatives to the arrangements discussed herein, as well as to the method and apparatus, may be employed, all within the spirit and scope of the invention as defined in the appended claims.

What is claimed is:

1. A plurality of laminated roofing shingles adapted to be arranged in a package that, when shingles are removed from the package and applied to a roof, the shingles will have a random pattern appearance when the plurality of shingles are installed in an array on the roof, the plurality of laminated shingles comprising:

(a) a first shingle having a dragon's tooth anterior layer of shingle material having a headlap portion and a tab portion, with the tab portion comprising a first number of tabs separated by openings between tabs wherein the sizes of the openings between tabs is in the range of 2 inches to 7 inches;

(b) a second shingle having a dragon's tooth anterior layer of shingle material having a headlap portion and a tab portion, with the tab portion comprising a second number of tabs separated by openings between tabs, with the second number of tabs being a different number than the first number of tabs, wherein the sizes of the openings between tabs is in the range of 2 inches to 7 inches; and (c) with each of the first and second shingles having a posterior layer of shingle material having no spaced-apart tabs, with the posterior layer laminated to an anterior layer of one of clauses (a) and (b); and (d) with spaced apart openings being located in the anterior layer of the first shingle and having a first common spacing between center lines of adjacent openings of the first shingle and with spaced apart openings being located in the anterior layer of the second shingle and having a second common spacing between center lines of adjacent openings of the second shingle, wherein the second spacing is a different spacing than the first spacing.

2. A roof having an array of the plurality of laminated roofing shingles according to claim 1, wherein the first and second shingles are arranged on the roof as any one or more of the following arrangements:

(a) adjacent to each other in a same course of shingles; and (b) with one of the shingles in partial overlap to the other of the shingles and in a next-adjacent course.

3. A package of shingles according to claim 1, wherein adjacent shingles in the package have different numbers of dragon's teeth thereon.

4. The package of shingles in accordance with claim 3, wherein a wrapper is disposed around the shingles in the package.

5. A package of shingles in accordance with claim 1, wherein the shingles are arranged in accordance with adjacent shingles in the package having different numbers of dragon's teeth thereon.

6. The package of shingles in accordance with claim 5, wherein a wrapper is disposed around the shingles in the package.

7. A package of shingles in accordance with claim 1, wherein the shingles are arranged in accordance with adjacent shingles in the package having anterior shingle layers disposed adjacent each other.

8. A The package of shingles in accordance with claim 7, wherein a wrapper is disposed around the shingles in the package.

9. A package of shingles in accordance with claim 1, with adjacent shingle in the package being arranged such that adjacent shingles in the package have dragon's teeth facing in the same direction in the package.

10. The package of shingles in accordance with claim 9, wherein a wrapper is disposed around the shingles in the package.

11. A package of shingles in accordance with claim 1, with adjacent shingles in the package being arranged such that adjacent shingles in the package have dragon's teeth facing in opposite directions in the package.

12. The package of shingles in accordance with claim 11, wherein a wrapper is disposed around the shingles in the package.

* * * * *